US008188206B2

(12) United States Patent
Ren

(10) Patent No.: US 8,188,206 B2
(45) Date of Patent: May 29, 2012

(54) 10-50 G/D HIGH STRENGTH POLYETHYLENE FIBER AND PREPARATION METHOD THEREOF

(75) Inventor: Yi Ren, Laiwu (CN)

(73) Assignee: Shandong ICD High Performance Fibres Co., Ltd., Shandong (CN)

( * ) Notice: Subject to any disclaimer, the term of this patent is extended or adjusted under 35 U.S.C. 154(b) by 265 days.

(21) Appl. No.: 12/600,252

(22) PCT Filed: Jul. 14, 2008

(86) PCT No.: PCT/CN2008/001311

§ 371 (c)(1), (2), (4) Date: Nov. 13, 2009

(87) PCT Pub. No.: WO2009/105926

PCT Pub. Date: Sep. 3, 2009

(65) Prior Publication Data

US 2010/0204427 A1 Aug. 12, 2010

(30) Foreign Application Priority Data

Feb. 26, 2008 (CN) ..... 2008 1 0014185

(51) Int. Cl.
*C08F 110/02* (2006.01)

(52) U.S. Cl. ..... 526/352; 264/184; 264/176.1; 264/210.8

(58) Field of Classification Search ..... 526/352; 264/184, 176.1, 210.8
See application file for complete search history.

(56) References Cited

U.S. PATENT DOCUMENTS

| | | | | |
|---|---|---|---|---|
| 4,228,118 | A | 10/1980 | Wu et al. | |
| 4,344,908 | A | 8/1982 | Smith et al. | |
| 4,455,273 | A * | 6/1984 | Harpell et al. | 264/184 |
| 6,669,889 | B2 | 12/2003 | Ohta et al. | |
| 7,056,579 | B2 * | 6/2006 | Sakamoto et al. | 428/364 |

FOREIGN PATENT DOCUMENTS

| | | | |
|---|---|---|---|
| CN | 1439752 | A | 9/2003 |
| CN | 1448546 | A | 10/2003 |
| CN | 1539033 | A | 10/2004 |
| CN | 1626705 | A * | 6/2005 |
| CN | 1995496 | A | 7/2007 |
| EP | 0064167 | B1 | 11/1985 |
| EP | 0205960 | A2 | 12/1986 |
| NL | 7900990 | | 2/1979 |

* cited by examiner

*Primary Examiner* — Ling Choi
(74) *Attorney, Agent, or Firm* — Kenyon & Kenyon LLP

(57) ABSTRACT

A 10-50 g/d high strength polyethylene fiber and preparation method thereof are provided, which are in the high molecular material field. Said fiber is obtained by cross blend melt spinning method, and its strength is 10-50 g/d, its modulus is 400-2000 g/d. The material used by said cross blend melt spinning method is obtained by mixing low density polyethylene with molecular weight of 2/5-500,000 and super molecule weight polyethylene with molecular weight of 120-7000,000 in the proportion of 2-10:1. Flow modifier or diluent is not additionally added in the present invention, raw material consumption is low, extra high pressure is avoided, energy consumption and cost of production are low, technological process is simple, single line capacity is easily raised, and large scale industrial production can be realized.

13 Claims, No Drawings

10-50 G/D HIGH STRENGTH POLYETHYLENE FIBER AND PREPARATION METHOD THEREOF

BACKGROUND

1. Field of the Invention

The present invention relates generally to polymer materials, and more specifically to a high strength polyethylene (HS-PE) fiber with a tensile strength ranging from 10 to 50 g/d obtained by a preparation method of melt spinning.

2. Description of Related Art

The high strength polyethylene fiber is a well known synthetic fiber with high strength and high elastic modulus, produced from ultrahigh molecular weight polyethylene (UHMWPE) with a molecular weight higher than 1,000,000. Right now, HS-PE fibers, Aramid fibers, and carbon fibers are considered three high performance fibers in the world. Due to its high strength, high modulus and low density, the UHMWPE fiber plays an important role not only in modern warfare, defense equipment and aerospace field, but also in civil fields. The HS-PE fiber is mostly produced by the melt spinning method and the gel spinning ultra-drawing method.

Chinese patent No. CN1539033 discloses an HS-PE fiber with a tensile strength higher than 15 cN/dtex, which is produced by a melt spinning process employing a polyethylene with a weight-average molecular weight lower than 300,000 and a ratio of the weight-average molecular weight to number-average molecular weight (Mw/Mn) less than 4.0 as the starting material. Because of the hyperviscosity, the melt has low fluidity, which makes it difficult to spin and to realize industrial production.

Since late 1970's, the gel spinning ultra-drawing method has been adopted by DSM Company (Netherlands) to realize the industrial production of UHMWPE. In this method, the UHMWPE is resolved by a solvent to relieve flexible polyethylene chain molecules from severe entanglement by the dilution effect. The precursor solution is then extruded from a spinneret hole and quenched to be phase-separated, and new-born gel precursor fibers with folded lamellar crystals and tie-molecule network are obtained. After solvent removing and ultra-after-drawing, final HS-PE fibers with linear chain structure are obtained.

Netherlandish patent NL 7900990 and U.S. Pat. No. 4,344,908 disclose the preparation method of a linear chain structure HS-PE fiber with a tensile strength higher than 35 g/d adopting decalin as a solvent. The spinning solution is prepared by dissolving UHMWPE in decalin. After extruding the precursor solution from a spinneret hole and quenching in air or cold water, new-born gel precursor fibers are obtained. Final HS-PE fibers with a linear chain structure are then obtained by solvent removing and ultra-heat-drawing.

European patents EP0064167 and EP0205960 and U.S. Pat. No. 4,455,273 disclose preparation methods of linear chain structure HS-PE fibers. The spinning solution is prepared by dissolving UHMWPE in a kerosene or white solvent. After a gel spinning process, extracting, drying and ultra heat-drawing, final HS-PE fibers with a linear chain structure are obtained.

Prior art melt spinning methods for preparing UHMWPE fibers employ UHMWPE as the only raw material, the melt of which causes unfavorable low fluidity. To solve this problem, flow modifiers or diluents as well as a spinning process under ultrahigh pressure are introduced to improve the fluidity, which make industrialization difficult. However, because of the lower orientation of crystallization resulted from the great number of entanglement points of the melt polyethylene chain molecules, HS-PE fibers can be hardly obtained when only PE with low molecular weight is employed.

No published literature on preparing HS-PE fibers with a tensile strength ranging from 10 to 50 g/d and tensile elastic modulus ranging from 400 to 2000 g/d based on the blend-melt-spinning process was found during a prior art search.

SUMMARY OF THE INVENTION

One objective of the present invention is to provide a blend-melt-spinning method for preparing HS-PE fibers with a tensile strength ranging from 10 to 50 g/d and tensile elastic modulus ranging from 400 to 2000 g/d by adopting UHMWPE and low density polyethylene (PE) as raw materials.

The technical solution of the present invention is as follows:

A high strength polyethylene fiber, wherein said fiber has a tensile strength ranging from 10 to 50 g/d and a tensile elastic modulus ranging from 400 to 2000 g/d, and is prepared by a blend-melt-spinning method.

A high strength polyethylene fiber, wherein said fiber has a tensile strength ranging from 10 to 20 g/d, or A high strength polyethylene fiber, wherein said fiber has a tensile strength ranging from 20 to 30 g/d, or A high strength polyethylene fiber, wherein said fiber has a tensile strength ranging from 30 to 40 g/d, or A high strength polyethylene fiber, wherein said fiber has a tensile strength ranging from 40 to 50 g/d.

When the tensile strength of the HS-PE fiber of the present invention ranges from 10 to 30 g/d, it can be generally used in, but not limited to, the following civil fields: (1) marine engineering, such as ropes, cables, sailing and fishing gears; (2) sports equipment, such as safety helmets, skiing boards, sailing boards, fishing rods, rackets, super-light parts of bicycles, gliding boards, and tip structure of aircrafts; (3) biological materials, for example, fiber reinforced composites in denture materials, medical grafts, plastic surgeries, and other clinical usages due to advantages such as good biocompatibility and durability, high stability and allergies-absence, and medical gloves and other medical facilities as well; and (4) industrial materials: such as pressure vessels, conveyers, filter materials, and car bumpers with the fiber and its composite materials. In addition, the fiber and its composite materials can be used in walls, partition structures and other building materials. The toughness of concrete can be improved when the fiber is used as the reinforced cement composite materials.

When the tensile strength of the HS-PE fiber of the present invention ranges from 30 to 50 g/d, it can be generally applied in, but not limited to, the following fields: (1) defense equipment, such as protective clothing, helmets, bullet-proof materials, helicopters, protective boards of tanks and armored ships, protective shells of radars, missile shield, bullet-proof vests, anti-thorn clothing, and shields; and (2) aerospace applications, such as tip structure of spacecrafts and aircrafts, and hydroplane.

The preparation method of the HS-PE with a tensile strength ranging from 10 to 50 g/d is characterized by adopting UHMWPE and low density PE in different weight ratios as starting materials in a blend-melt-spinning method, wherein said weight ratio of the low density PE and UHMWPE is from 2:1 to 10:1, the molecular weight of the low density PE is between 25,000 and 500,000 and the molecular weight of the UHMWPE ranges from 1,200,000 to 7,000,000.

The preparation process of the HS-PE with a tensile strength ranging from 10 to 50 g/d of the present invention is described in detail as follows:

1) Mixing the Raw Materials

Evenly mixing low density PE and UHMWPE with a weight ratio of 2:1 to 10:1.

2) Blend-Melting

A polyethylene melt is obtained by melting the mixed solution of step 1) in a twin-screw extruder with a temperature between 150 and 300° C.

3) Preparing a New-Born Fiber and Drawing

The obtained polyethylene melt is extruded from a spinning plate of a spinning box, and the spray speed is about 3 to 5 m/min. Subsequently, the new-born fiber is obtained through cooling molding of extruded filatures by a blast apparatus. The cold temperature is maintained between 0 and 35° C. and the wind speed is about 5 to 8 m/s. The new-born fiber is drawn in a godet roller and the draft multiple is 2 to 10 times.

4) Drawing in Two Oil Baths

The new born fiber is transferred into two oil baths filled with glycol by a godet roller and stretched evenly. The temperature of the oil baths may be maintained between 50 and 150° C. The total draft multiple is 3 to 20 times.

5) Removing Oil in a Water Bath

The drafted fiber is washed in a water bath containing heterogeneous alcohol surfactants with a temperature between 60 and 100° C.

6) Drying the Fiber to obtain the HS-PE Fiber

After being washed, the fiber is dried to remove the water and wound onto a tube to get the HS-PE fiber with a tensile strength ranging from 10 to 50 g/d.

The beneficial effects of the product in this invention include:

1) It is unnecessary to introduce flow modifiers or diluents into the melt liquid. According to the mix ratio of the present invention, UHMWPE can enhance the strength of entangle point of the low density PE, which facilitates back-drawing.

2) The HS-FE fiber produced by the present invention possesses a tensile strength ranging from 10 to 50 g/d, tensile elastic modulus ranging from 400 to 2000 g/d and the passing ratio higher than 98%, which can fully satisfy the requirements of civil and military applications.

3) HS-FE fibers with a tensile strength less than 30 g/d prepared by the present invention fill the gaps in the domestic market.

4) In comparison with the prior art, the present invention has advantages such as shorter producing process, simpler equipment requirements, less consumption of raw materials (including the solvent), no ultra-high pressure requirement, lower energy consumption and lower production costs. In addition, it increases the producing capacity due to the single line producing process, which facilitates large-scale industrial production.

EMBODIMENTS

EXAMPLE 1

1) Choice of Raw Materials

UHMWPE with a number-average molecular weight of 6,000,000 and low density PE with a number-average molecular weight of 25,000 are employed as raw materials.

2) Mixing of Raw Materials

A uniform solution is obtained by mixing the low density PE and UHMWPE at a weight ratio of 10:1.

3) Blend-Melting through a Twin-Screw Extruder

A polyethylene melt with a viscosity between 1000 and 3000 Pa·S is obtained by melting the mixture solution of step 2) in a twin-screw extruder with a temperature between 150 and 300° C.

4) New-Born Fiber Preparing and Drawing

The obtained polyethylene melt is extruded from a spinning plate of a spinning box and the spray speed is 3 m/min. Subsequently, a new-born fiber is obtained through cooling molding of extruded filatures by a blast apparatus. The cooling temperature is 20° C. and the wind speed is 5 m/s. The new-born fiber is drawn in a godet roller and the draft multiple is 2 times.

5) Drawing in Two Oil Baths

The new born fiber is transferred into two oil baths filled with glycol by the godet roller and is stretched evenly. The temperature of the first oil bath is 115° C. and the draft multiple is 4 times. The temperature of the second oil bath is 130° C. and the draft multiple is 2 times. The total draft multiple in the two oil baths is 8 times.

6) Oil Removal in a Water Bath

The drafted fiber is washed in a water bath containing heterogeneous alcohol surfactants at 80° C., and the oil is removed from the fiber surface.

7) Drying the Fiber to obtain an HS-PE Fiber

The washed fiber is dried to remove the water and is wound onto a tube to get an HS-PE fiber with a tensile strength of 15 g/d.

It is found in tests that the HS-PE fiber obtained by this process possesses a tensile strength of 10 g/d, a tensile elastic modulus of 400 g/d and the elongation at break is of 3.5%. The passing rate is about 99%.

EXAMPLE 2

1) Choice of Raw Materials

UHMWPE with a number-average molecular weight of 5,000,000 and low density PE with a number-average molecular weight of 40,000 are employed as raw materials.

2) Mixing the Raw Materials

A uniform solution is obtained by mixing the low density PE and UHMWPE at a weight ratio of 8:1.

3) Blend-Melting through the Twin-Screw Extruder

A polyethylene melt with a viscosity between 1000 and 3000 Pa·S is obtained by melting the mixture solution of step 2) in a twin-screw extruder with a temperature between 150 and 300° C.

4) New-Born Fiber Preparing and Drawing

The obtained polyethylene melt is extruded from a spinning plate of a spinning box and the spray speed is 5 m/min. Subsequently, a new-born fiber is obtained through cooling molding of extruded filatures by a blast apparatus. The cooling temperature is 35° C. and the wind speed is 8 m/s. The new-born fiber is then drawn in a godet roller and the draft multiple is 4 times.

5) Drawing in Two Oil Baths

The new born fiber is transferred into two oil baths filled with glycol by the godet roller and is stretched evenly. The temperature of the first oil bath is 120° C. and the draft multiple is 3 times. The temperature of the second oil bath is 130° C. and the draft multiple is 3 times.

6) Oil removal in a water bath

The drafted fiber is washed in a water bath containing heterogeneous alcohol surfactants at 95° C.

7) Drying the Fiber to obtain an HS-PE Fiber

The washed fiber is dried to remove water and is wound onto a tube to get an HS-PE fiber with a tensile strength of 20 g/d.

It is found in tests that the HS-PE fiber obtained in this process possesses a tensile strength of 20 g/d, a tensile elastic modulus of 500 g/d and the elongation at break of 2.7%. The passing rate is about 99%.

EXAMPLE 3

1) Choice of Raw Materials

UHMWPE with a number-average molecular weight of 5,000,000 and low density PE with a number-average molecular weight of 30,000 are employed as starting materials.

2) Mixing the Raw Materials

A uniform solution is obtained by mixing the low density PE and UHMWPE at a weight ratio of 5:1.

3) Blend-Melting through a Twin-Screw Extruder

A polyethylene melt with a viscosity between 1000 and 3000 Pa·S is obtained by melting the mixture solution of step 2) in a twin-screw extruder with a temperature between 150 and 300° C.

4) New-Born Fiber Preparing and Drawing

The obtained polyethylene melt is extruded from a spinning plate of a spinning box and the spray speed is 4 m/min. Subsequently, a new-born fiber is obtained through cooling molding of extruded filatures by a blast apparatus. The cooling temperature is 25° C. and the wind speed is 6 m/s. The new-born fiber is then drawn in a godet roller and the draft multiple is 5 times.

5) Drawing in Two Oil Baths

The new born fiber is transferred into two oil baths filled with glycol by the godet roller and is stretched evenly. The temperature of the first oil bath is 100° C. and the draft multiple is 3.5 times. The temperature of the second oil bath is 130° C. and the draft multiple is 4 times.

6) Oil Removal in a Water Bath

The drafted fiber is washed in a water bath containing heterogeneous alcohol surfactants at 90° C.

7) Drying the Fiber to obtain an HS-PE Fiber

The washed fiber is dried to remove water and is wound onto a tube to get an HS-PE fiber with a tensile strength of 30 g/d.

It is found in tests that the HS-PE fiber obtained in this process possesses a tensile strength of 30 g/d, a tensile elastic modulus of 980 g/d and the elongation at break of 2.8%. The passing rate is about 98%.

EXAMPLE 4

1) Choice of Raw Materials

UHMWPE with a number-average molecular weight of 4,000,000 and low density PE with a number-average molecular weight of 30,000 are employed as raw materials.

2) Mixing the Raw Materials

A uniform solution is obtained by mixing the low density PE and UHMWPE at a weight ratio of 4:1.

3) Blend-Melting through a Twin-Screw Extruder

A polyethylene melt with a viscosity between 1000 and 3000 Pa·S is obtained by melting the mixture solution of step 2) in a twin-screw extruder with a temperature between 150 and 300° C.

4) New-Born Fiber Preparing and Drawing

The obtained polyethylene melt is extruded from a spinning plate of a spinning box and the spray speed is 4 m/min. Subsequently, a new-born fiber is obtained through cooling molding of extruded filatures by a blast apparatus. The cooling temperature is 25° C. and the wind speed is 6 m/s. The new-born fiber is then drawn in a godet roller and the draft multiple is 5 times.

5) Drawing in Two Oil Baths

The new born fiber is transferred into two oil baths filled with glycol by the godet roller and is stretched evenly. The temperature of the first oil bath is 115° C. and the draft multiple is 4 times. The temperature of the second oil bath is 130° C. and the draft multiple is 4 times.

6) Oil Removal in a Water Bath

The drafted fiber is washed in a water bath containing heterogeneous alcohol surfactants at 90° C.

7) Drying the Fiber to obtain an HS-PE Fiber

The washed fiber is dried to remove water and is wound onto a tube to get an HS-PE fiber with a tensile strength of 40 g/d.

It is found in tests that the HS-PE fiber obtained in this process possesses a tensile strength of 40 g/d, a tensile elastic modulus of 1500 g/d and the elongation at break of 2.9%. The passing rate is about 98.5%.

EXAMPLE 5

1) Choice of Raw Materials

UHMWPE with a number-average molecular weight of 5,000,000 and low density PE with a number-average molecular weight of 30,000 are employed as raw materials.

2) Mixing the Raw Materials

A uniform solution is obtained by mixing the low density PE and UHMWPE at a weight ratio of 3.5:1.

3) Blend-Melting through a Twin-screw Extruder

A polyethylene melt with a viscosity between 1000 and 3000 Pa·S is obtained by melting the mixture solution of step 2) in a twin-screw extruder with a temperature between 150 and 300° C.

4) New-Born Fiber Preparing and Drawing

The obtained polyethylene melt is extruded from a spinning plate of a spinning box and the spray speed is 4 m/min. Subsequently, a new-born fiber is obtained through cooling molding of extruded filatures by a blast apparatus. The cooling temperature is 20° C. and the wind speed is 6 m/s. The new-born fiber is then drawn in a godet roller and the draft multiple is 5 times.

5) Drawing in Two Oil Baths

The new born fiber is transferred into two oil baths filled with glycol by the godet roller and is stretched evenly. The temperature of the first oil bath is 115° C. and the draft multiple is 4 times. The temperature of the second oil bath is 130° C. and the draft multiple is 5 times.

6) Oil Removal in a Water Bath

The drafted fiber is washed in a water bath containing heterogeneous alcohol surfactants at 90° C.

7) Drying the Fiber to obtain an HS-PE Fiber

The washed fiber is dried to remove water and is wound onto a tube to get an HS-PE fiber with a tensile strength of 50 g/d.

It is found in tests that the HS-PE fiber obtained in this process possesses a tensile strength of 50 g/d, a tensile elastic modulus of 1800 g/d and the elongation at break of 2.7%. The passing rate is about 99%.

The above-mentioned embodiments are only used to illustrate the present invention, not intended to limit the scope thereof. Many modifications of the embodiments can be made without departing from the spirit of the present invention.

What is claimed is:

1. A method for preparing a high strength polyethylene (HS-PE) fiber with a tensile strength ranging from 10 to 50 g/d, comprising: using low density polyethylene (PE) and ultrahigh molecular weight polyethylene (UHMWPE) as raw materials at a weight ratio in a blend-melt-spinning method, wherein said weight ratio of the low density PE and UHMWPE is from 2:1 to 10:1, a molecular weight of the low density PE is between 25,000 and 200,000, and a molecular weight of the UHMWPE is from 1,200,000 to 7,000,000.

2. The method according to claim 1, further comprising:

mixing the low density PE and UHMWPE to obtain a mixture;

melting the mixture in a twin-screw extruder with a temperature between 150 and 300° C. to obtain a polyethylene melt;

extruding the polyethylene melt from a spinning plate of a spinning box at a spray speed of about 3 to 5 m/min;

obtaining a new-born fiber through cooling molding of extruded filatures by a blast apparatus, wherein a cooling temperature is maintained between 0 and 35° C. and a wind speed is about 5 to 8 m/s;

drawing the new-born fiber in a godet roller, wherein a draft multiple is 2 to 6 times;

transferring the new born fiber into two oil baths filled with glycol by the godet roller and stretching the new born fiber evenly, wherein a temperature of at least one of the oil baths is maintained between 50 and 150° C., and a total draft multiple is 3 to 20 times;

washing the drafted fiber in a water bath containing heterogeneous alcohol surfactants with a temperature between 60 and 100° C.; and drying the washed fiber to remove water and winding the dried fiber onto a tube.

3. A method for preparing a high strength polyethylene (HS-PE) fiber with a tensile strength ranging from 10 to 50 g/d, comprising: using low density PE and UHMWPE as raw materials at a weight ratio from 2:1 to 10:1 in a blend-melt-spinning method.

4. The method of claim 3, further comprising:

mixing the low density PE and UHMWPE to obtain a mixture; and melting the mixture to obtain a polyethylene melt.

5. The method of claim 4, wherein the mixture is melt in a twin-screw extruder with a temperature between 150 and 300° C.

6. The method of claim 4, further comprising: extruding the polyethylene melt.

7. The method of claim 6, wherein the polyethylene melt is extruded from a spinning plate of a spinning box at a spray speed of about 3 to 5 m/min.

8. The method of claim 6, further comprising: obtaining a new-born fiber through cooling molding of extruded filatures.

9. The method of claim 8, wherein the cooling molding is done by a blast apparatus, wherein a cooling temperature is maintained between 0 and 35° C.

10. The method of claim 8, further comprising: drawing the new-born fiber.

11. The method of claim 10, wherein the new-born fiber is drawn in a godet roller, wherein a draft multiple is 2 to 6 times.

12. The method of claim 10, further comprising: transferring the new born fiber into an oil bath.

13. The method of claim 12, wherein the oil bath is filled with glycol and wherein a temperature of the oil bath is maintained between 50 and 150° C.

* * * * *